United States Patent [19]

Gibbens, Jr.

[11] Patent Number: 5,016,229

[45] Date of Patent: May 14, 1991

[54] ELECTRONICALLY OPERATED CLOCK FOR HEARING IMPAIRED PERSONS

[76] Inventor: Harry C. Gibbens, Jr., 11327 Louise Ave., Lynwood, Calif. 90262-3113

[21] Appl. No.: 544,186

[22] Filed: Jun. 25, 1990

[51] Int. Cl.[5] ..... G04B 47/00; G04C 21/16

[52] U.S. Cl. ..... 368/10; 368/256

[58] Field of Search ..... 368/10, 79, 256; 307/139, 141, 141.4, 141.8

[56] References Cited

U.S. PATENT DOCUMENTS

| | | | |
|---|---|---|---|
| 1,943,598 | 1/1934 | Gourley | 368/256 |
| 2,045,798 | 6/1936 | Purvis | 368/256 |
| 2,276,339 | 3/1942 | Price | 368/256 |
| 2,598,978 | 6/1952 | DeMartin | 368/256 |
| 3,545,195 | 12/1970 | Krischrer | 368/256 |

*Primary Examiner*—Vit W. Miska

*Attorney, Agent, or Firm*—Erik M. Arnhem

[57] ABSTRACT

An electronic circuit for energizing an electric lamp associated with an alarm clock. Alarm circuitry within the clock energizes an electronic flasher that delivers a control signal to a bidirectional switch means in an A.C. circuit containing the lamp. The switch means triggers a two direction silicon controlled switch means in the lamp circuit. The lamp provides an optical alarm that can be used as a wake-up signal by persons who are deaf but who can see.

2 Claims, 1 Drawing Sheet

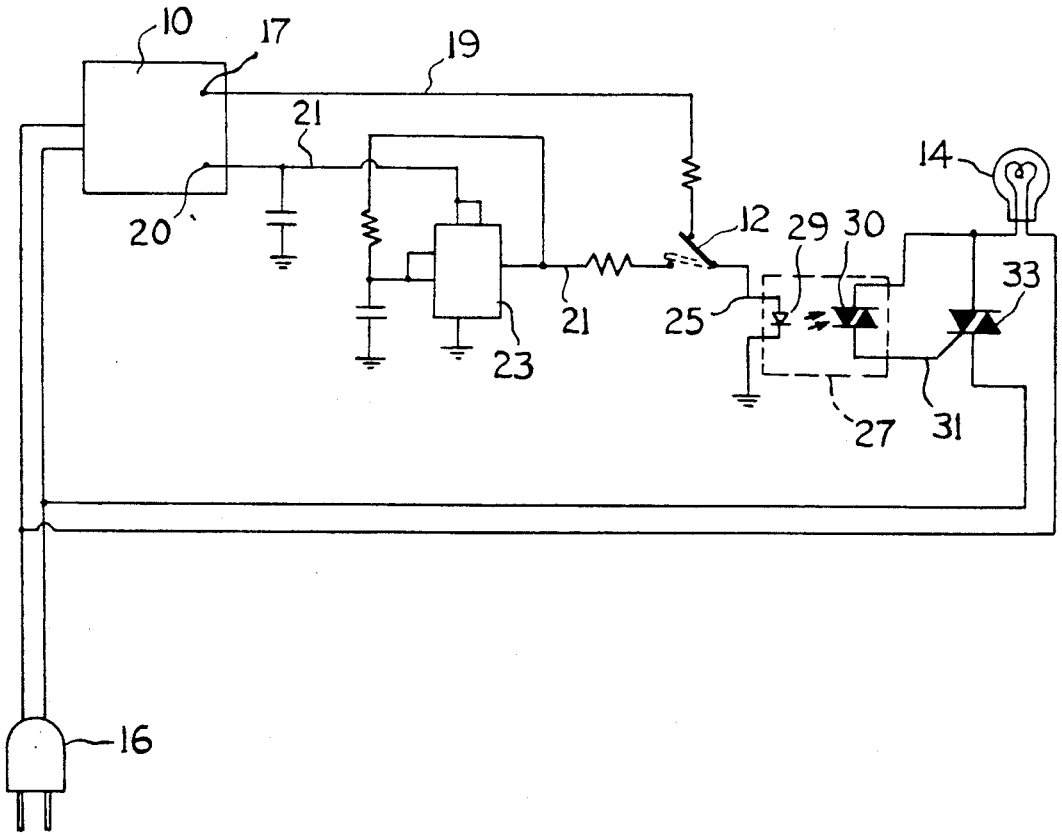
10
17
19
21
14
20
12
29
30
33
21
25
23
27
31
16

ELECTRONICALLY OPERATED CLOCK FOR HEARING IMPAIRED PERSONS

BACKGROUND AND SUMMARY OF THE INVENTION

This invention relates to an electronically operated clock, modified to produce an optically-visible flashing alarm signal. The clock is intended to be primarily usable by persons who can see, but who are deaf or hard of hearing and hence cannot hear an audible alarm signal. The flashing optical signal can, after a short period of time, act on the deaf person's subconscious mind to awaken him or her from sleep. A manual switch is incorporated into the clock output circuitry to permit a continuously "on" condition. This feature enables the lamp to be used either as an alarm device or as a reading lamp. The lamp may be a conventional sixty watt (or other wattage) bulbs mounted in an electrical socket mounted directly on the outer wall of the clock housing.

A principal object of the invention is to provide a lamp-energizer circuit that operates electronically, without mechanical relays or movable components subject to wear or premature failure. The electronic circuitry will have the further advantage of being noiseless and of being energy efficient.

THE DRAWINGS

The single FIGURE is a schematic diagram of an electronic circuit that can be used in practicing the invention.

BRIEF DESCRIPTION OF A PREFERRED EMBODIMENT OF THE INVENTION

In the drawing numeral 10 references the counting circuitry contained within a conventional electronically-operated clock. The clock will include a front face adapted to digitally display the time in hours and minutes. The display can include liquid crystal display line segments selectively energized to form numbers representing the hours and minutes.

Various hand-operated controls can be incorporated into the top wall of the clock cabinet to adjust (set) the time and alarm functions. Additionally, a toggle switch can be located on the clock cabinet to control the delivery of electrical power to an electric socket on the clock cabinet. In the drawing this toggle switch is referenced by numeral 12. The associated lamp is identified by numeral 14.

The clock can be energized from a conventional A.C. source, that may be one hundred twenty volts and sixty cycles. The drawing shows can an electrical plug 16 adapted to be inserted into a wall receptacle for delivering A.C. power to clock circuitry 10 and external lamp.

The clock circuitry has an output terminal 17 connected to a D.C. output line 19 that is adapted to maintain lamp 14 in a "continuous on" condition when switch 12 is in its illustrated position. The clock circuitry has a second output terminal 20 connected to a D.C. output line 21 that is adaped to maintain lemp 14 in a "flashing" condition when switch 12 is adjusted to an alternate position (dashed lines), and a control signal is present at terminal 20.

D.C. output line 19 will hereinafter be referred to as an output lamp accessory line. D.C. output line 21 will be referred to an alarm signal output line. Line 21 will only be energized when clock circuitry delivers an alarm signal from terminal 20, i.e. when the time reading on the clock coincides with the manually-set alarm time selected by the person using the clock.

Line 21 includes therein a conventional electronic timer (flasher) means 23. When line 21 is energized it will carry-spaced current pulses from alarm terminal 20 through switch 12 to an interaction line 25. Line 25 is part of the D.C. circuit, but it is connected to an electronic switch means 27 that transfers an electronic signal from the D.C. circuit into the A.C. circuit that contains lamp 14.

Switch means 27 includes an infrared emitting diode 29 and a light activated triac driver 30. The triac acts as a bilateral switch for delivering a triggering signal through line 31 to the control terminal of a triac 33. The triac is a two direction silicon controlled rectifier means that, when triggered by a signal in line 31, transmits A.C. current through lamp 14.

Lamp 14 has two operational modes. When switch 12 is in its illustrated position the lamp is continuously on in this operating mode the lamp can be used for reading or general illumination. When switch 12 is in its dashed line position lamp 14 will be in a flashing condition whenever there is an alarm signal at terminal 20.

In a real life embodiment the circuity shown in the drawing will be contained within the clock housing, except that switch 12 and the socket for lamp 14 will be on the exterior wall of the clock housing.

What is claimed is:

1. In an electronically-operated alarm clock having a first D.C. output lamp accessory line, and a second D.C. alarm signal output line: the improvement comprising an electronic flasher means in said alarm signal output line; an A.C.-D.C. interaction line; a manual switch means operable to selectively connect said A.C.-D.C. interaction line to said alarm signal line or to said lamp accessory line; and A.C. circuit that includes a lamp, a two direction silicon controlled rectifier means in series with the lamp, and means for triggering said two direction silicon controlled rectifier means; and an electronic switch means for transferring an electric signal from the A.C.-D.C. interaction line to the A.C. circuit whereby said lamp can be energized by a signal through either output line.

2. The improvement of claim 1 wherein said triggering means comprises a light activitated triac driver, and said two direction silicon controlled rectifier means comprises a triac.

* * * * *